US008294346B2

(12) United States Patent
Malek et al.

(10) Patent No.: US 8,294,346 B2
(45) **Date of Patent: *Oct. 23, 2012**

(54) OPEN-CHAMBER MULTI-SPARK PLUG

(75) Inventors: Nadim Malek, Versailles (FR); Andre Agneray, Boulogne Billancourt (FR)

(73) Assignee: Renault S.A.S., Boulogne Billancourt (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/048,455

(22) Filed: Mar. 15, 2011

(65) Prior Publication Data

US 2011/0163654 A1 Jul. 7, 2011

Related U.S. Application Data

(63) Continuation of application No. 11/911,053, filed as application No. PCT/FR2006/050302 on Apr. 5, 2006, now Pat. No. 7,928,642.

(30) Foreign Application Priority Data

Apr. 8, 2005 (FR) ..... 05 50905

(51) Int. Cl.
*H01T 13/20* (2006.01)

(52) U.S. Cl. ..... 313/143; 131/142; 131/118

(58) Field of Classification Search ..... 313/118–145; 123/143, 169 R; 445/7; 219/121.64
See application file for complete search history.

(56) References Cited

U.S. PATENT DOCUMENTS

| | | | |
|---|---|---|---|
| 2,493,743 | A | 1/1950 | Benson |
| 2,902,747 | A | 9/1959 | Reiter |
| 3,440,870 | A | 4/1969 | Leto |
| 5,731,654 | A | 3/1998 | Benedikt et al. |

FOREIGN PATENT DOCUMENTS

| | | |
|---|---|---|
| FR | 2 859 830 | 3/2005 |
| FR | 2 859 831 | 3/2005 |
| FR | 2 859 869 | 3/2005 |
| WO | 01 20162 | 3/2001 |

*Primary Examiner* — Anh Mai
*Assistant Examiner* — Elmito Breval
(74) *Attorney, Agent, or Firm* — Oblon, Spivak, McClelland, Maier & Neustadt, L.L.P.

(57) ABSTRACT

An internal combustion engine radio frequency spark plug including two plasma-generating electrodes, separated by an insulator, that constitute respectively an outer shell enclosing the insulator and a central electrode housed in a central bore of the insulator. The spark plug includes a deep opening over the entire circumference of the shell, forming a heat-exchanger chamber inside the spark plug shell, opening outwards.

18 Claims, 3 Drawing Sheets

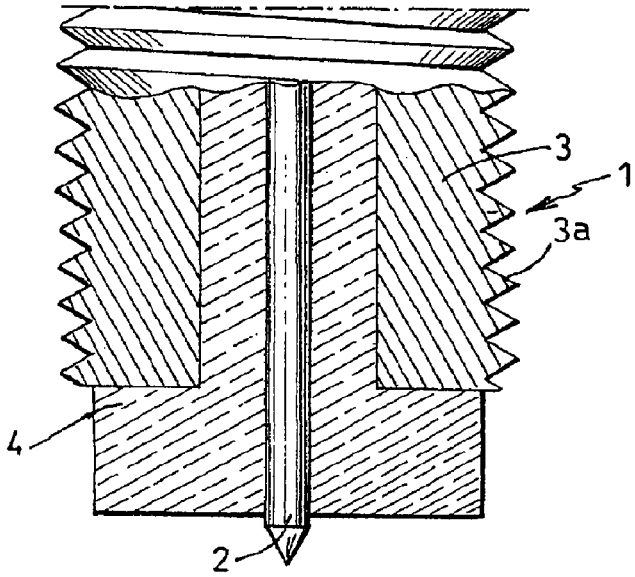
FIG.1
FIG.2
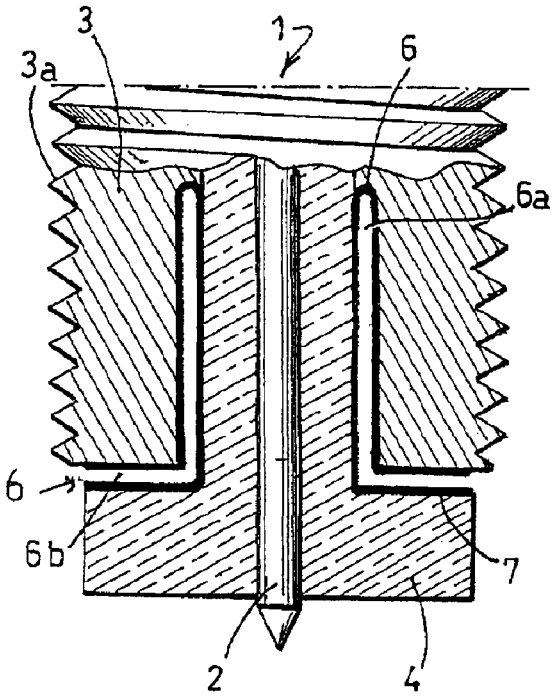
FIG.3
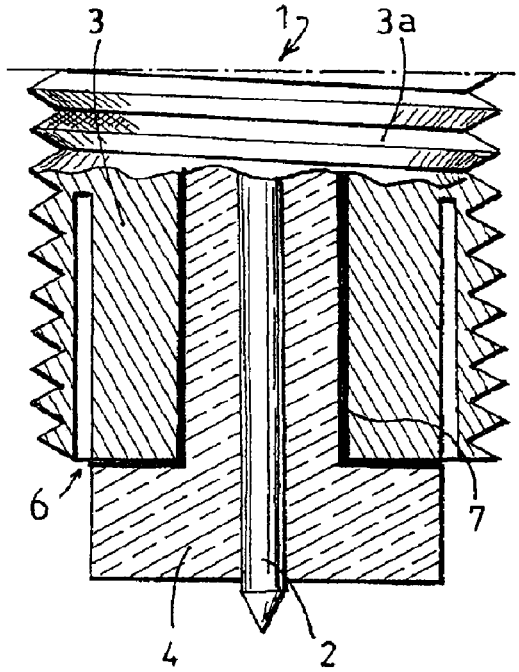

FIG.4A
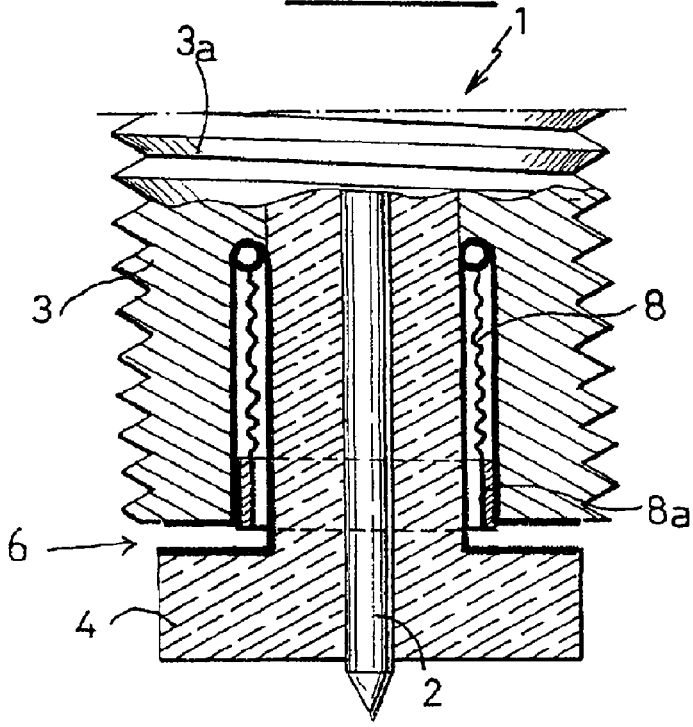
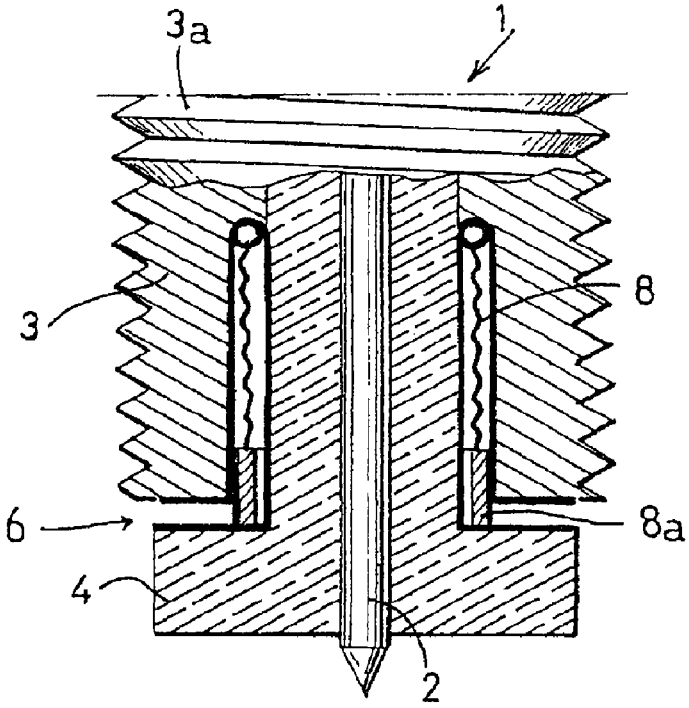
FIG.4B

FIG.5A
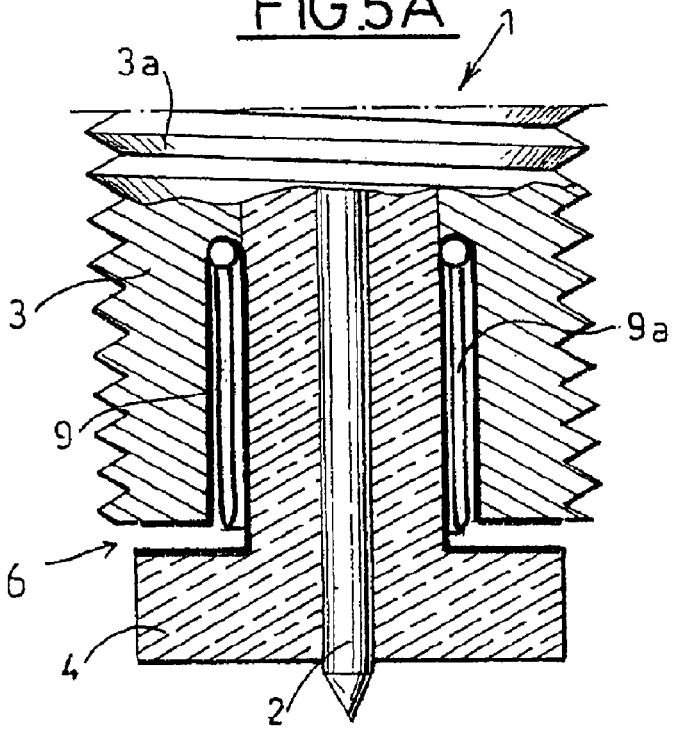
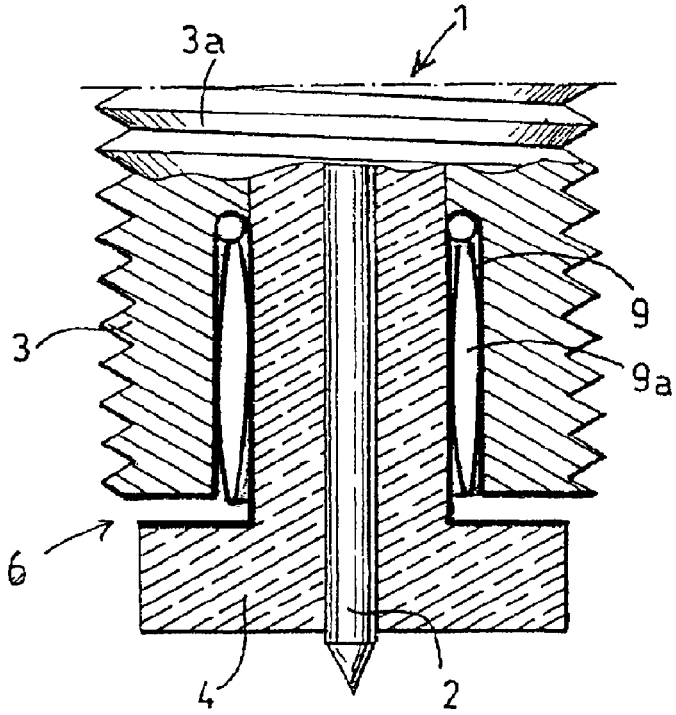
FIG.5B

OPEN-CHAMBER MULTI-SPARK PLUG

CROSS-REFERENCE TO RELATED APPLICATIONS

This application is a continuation of U.S. application Ser. No. 11/911,053, filed May 9, 2008, the entire content of which is incorporated herein by reference. U.S. application Ser. No. 11/911,053, is the national stage of International Patent Application No. PCT/FR06/50302, filed Apr. 5, 2006, and pursuant to 35 U.S.C. 119 claims the benefit of priority of France Application No. 0550905, filed Apr. 8, 2005.

BACKGROUND OF THE INVENTION

1. Field of the Invention

The present invention relates to a plasma-generating spark plug used in particular for the ignition of internal combustion engines using electric sparks between the electrodes of a spark plug.

More specifically, the invention relates to an internal combustion engine radio-frequency spark plug comprising two plasma-generating electrodes separated by an insulator, it being possible for one of the two electrodes to consist of the entirety of the cylinder head and of the shell of the spark plug.

Plasma-generating spark plugs are high-frequency multi-spark ignition systems capable of providing ignition in spark-ignition engines under the best conditions while at the same time reducing polluting emissions, particularly under lean burn conditions. They are liable to coking, particularly when cold.

Like all spark plugs, they are characterized by a thermal index. This index takes account of their thermal behavior at particular engine operating points. In particular, it provides an indication as to their ability to withstand temperatures that are high enough to avoid coking by pyrolysis, without suffering from "pre-ignition".

2. Description of the Related Art

Publications FR 2859830, FR 2859869 and FR 2859831 disclose a multi-spark spark plug known as a cold spark plug because it does not come up to temperature quickly enough to avoid coking. Indeed, the buildup of a deposit of carbon or coke on the electrodes is observed with such spark plugs and this significantly reduces the insulation needed between the tip of the central electrode and the shell. With poor insulation, there is a risk that the high-voltage power applied to the spark plug might not be high enough to be able to cause the necessary "breakdowns" that trigger the sparks.

To avoid coking, particularly when cold, of the spark plug electrode exposed to the atmosphere of the combustion chamber, one solution might be to increase the temperature of the insulator, to encourage the destruction of deposits through a pyrolysis phenomenon. This temperature is dependent on the thermal resistance of the spark plug as a whole, including its insulator.

The steps usually taken to increase the temperature of the insulator are limited by the onset of "pre-ignition" at the spark plugs, when these reach excessively high temperatures during operation.

BRIEF SUMMARY

It is an object of the present invention to regulate the thermal index of a multi-spark spark plug so it can come up to temperature quickly, without the risk of suffering from pre-ignition later.

To this end, the invention anticipates forming a deep opening around the entire circumference of the shell, this opening forming a heat exchange chamber inside the shell of the spark plug open to the outside.

According to a preferred embodiment of the invention, the chamber is positioned between the shell and the insulator.

According to the invention, the chamber may contain an expansion piece capable of opening or closing its inlet to hot gases.

The proposed steps make it possible to limit the cooling of the ceramic during the start-up phase without increasing its operating temperature. This then yields a non-linear thermal index which corresponds to rapid heating of the spark plug but without the risk of pre-ignition when hot.

BRIEF DESCRIPTION OF THE DRAWINGS

The present invention will be better understood from reading the following description of some non-limiting embodiments thereof, with reference to the attached drawings, in which:

FIG. 1 illustrates the known state of the art,

FIGS. 2, 3, 4A-4B and 5A-5B illustrate four embodiments of the invention.

DETAILED DESCRIPTION

FIG. 1 depicts a multi-spark spark plug 1 of known type comprising two plasma-generating electrodes 2, 3 separated by an insulator 4 made of a dielectric material such as a ceramic. The two electrodes 2, 3 respectively constitute an outer shell 3 surrounding the insulator, and a central electrode 2 housed in a central bore of the insulator 4. The shell 3 in the conventional way has an external screw thread 3*a* so that the spark plug can be screwed into the engine cylinder head. As mentioned earlier, when the insulator 4 has not reached a high enough temperature, coke deposits disrupt the operation of the spark plug by creating current leakage paths. Above and beyond a certain temperature, of the order of 400° C., the deposited coke is destroyed by pyrolysis.

The spark plug in FIG. 2 additionally has a dead volume 6 constituting a chamber open to the outside. The chamber 6 runs between the shell 3 and the insulator 4. According to the diagram, the chamber may advantageously have a tubular first sector 6*a* connected to a circular second sector 6*b* open to the outside.

According to another feature of the invention, demonstrated in FIG. 2, the walls of the chamber 6 may be metalized. The metal layer or sleeve 7 applied to the insulator is then in direct contact with the hot gases, which are also particularly oxidizing under lean burn conditions, of the combustion chamber. Metalizing the walls of the chamber 6 in particular makes it possible to prevent plasma from being created between the ceramic of the insulator and the shell. This metallic layer 7 may for example, consist of a sleeve brazed onto the ceramic, which will give the latter the ability to withstand the oxidizing gases. In practice, the thickness of the sleeve may be a compromise between its ability to withstand thermo-chemical erosion, its thermal resistance and the cost of producing it. Indeed, if the sleeve is too thick, its thermal resistance will be too low, and the ceramic will not heat up enough to destroy the deposits by pyrolysis. The material of which the sleeve is made must also be chosen according to its conductivity and its expansion coefficient, which needs to be compatible with that of the ceramic and with the mechanical properties thereof. Finally, without department from the scope of the invention, the metallic layer may itself be protected by an inert coating, a thin layer of ceramic or some other metallic coating particularly well able to withstand oxidation, such as nickel.

FIG. 3 illustrates a second embodiment of the invention whereby the chamber 6 is a simple tubular opening formed in the mass of the shell 3. In this case, the chamber no longer extends between the shell and the insulator as before but constitutes a cutout in the mass of the shell. The application of a metallic layer 7 is essential to prevent a plasma from forming. Here, the metalization can be applied simply to the interface between the ceramic 4 and the shell 3, independently of the chamber 6.

FIGS. 4A to 5B illustrate additional arrangements that allow the behavior of the chamber to adapt automatically to the temperature conditions of the spark plug so as further to improve the "non-linear" regulation of the thermal index of the spark plug, particularly to make it behave like a very hot spark plug when the engine is still cold and like a warm spark plug when the engine is hot, particularly under heavy load.

As indicated in these figures, the chamber 6 may contain an expansion piece 8, 9 capable of opening or closing its inlet to hot gases. When the temperature is low, the expansion piece is contracted and opens the passage to the hot gases which supply a stream of heat accelerating the operation of the spark plug. Once the spark plug has reached its operating temperature, the piece is expanded and closes the passage to hot gases. Thus, the spark plug reaches its thermal equilibrium at a lower temperature than if the chamber had remained open.

In FIGS. 4A and 4B the expansion piece 8 is a corrugated sleeve, one end of which is fixed and the other end of which carries a cylindrical shutter 8*a* that closes off the inlet to the chamber 6 when the sleeve has expanded.

In FIGS. 5A and 5B, the expansion piece 9 is a double-walled sleeve containing a metal 9*a* that melts at a relatively low temperature: expansion of the liquid metal 9*a* causes the sleeve 9 to swell, thus blocking off the passage to the hot gases.

These two arrangements are nonlimiting and of course, other types of shutter based, for example, on flanges acting as shutters, or on the use of shape memory alloys or a bi-material strip, may also be envisioned.

In conclusion, it must be emphasized that all the measures proposed by the invention rely on the creation of an empty space, or open chamber, between the insulator and the shell, making it possible to regulate the thermal index of the spark plug and, in particular to obtain a non-linear thermal index. Furthermore, metalizing the walls of the chamber is a solution particularly well-suited to lean-burn running, because it protects the ceramic from the oxidizing agents in the combustion gases.

The invention claimed is:

1. An internal combustion engine radio-frequency spark plug, comprising:

a first plasma-generating electrode;

a second plasma-generating electrode, the second plasma-generating electrode including an annular opening that extends from an exterior face into an interior of the second plasma-generating electrode such that a portion of the second plasma-generating electrode is positioned radially inward towards the first plasma-generating electrode from the annular opening to form a heat-exchange chamber opening to an outside of the spark plug; and an insulator that separates the first plasma-generating electrode and the second plasma-generating electrode.

2. The spark plug as claimed in claim 1, further comprising an expansion piece positioned in the chamber and configured to open or close an inlet to the chamber to hot gases.

3. The spark plug as claimed in claim 2, wherein the expansion piece includes a corrugated sleeve, one end of which is fixed and an other end of which carries a shutter that closes off the inlet to the chamber when the sleeve has expanded.

4. The spark plug as claimed in claim 2, wherein the expansion piece includes a double-walled sleeve containing a metal that melts at a relatively low temperature, expansion of which causes the sleeve to swell so as to close off the inlet to the chamber.

5. The spark plug as claimed in claim 1, wherein the first plasma-generating electrode is a central electrode housed in a central bore of the insulator.

6. The spark plug as claimed in claim 1, wherein the second plasma-generating electrode is an outer shell surrounding the insulator.

7. The spark plug as claimed in claim 1, wherein an interior face of the second plasma-generating electrode is metalized.

8. The spark plug as claimed in claim 1, wherein the annular opening extends into the interior of the second plasma-generating electrode such that the portion of the second plasma-generating electrode is positioned radially inward towards the first plasma-generating electrode from the annular opening and another portion of second plasma-generating electrode that is positioned radially outward from the annular opening.

9. An internal combustion engine radio-frequency spark plug, comprising:

a first plasma-generating electrode;

a second plasma-generating electrode;

an insulator that separates the first plasma-generating electrode and the second plasma-generating electrode; and an expansion piece positioned in a chamber between the second plasma-generating electrode and the insulator, wherein the expansion piece is configured to move between a first position in which the expansion piece does not block an inlet to the chamber to hot gases and a second position in which the expansion piece blocks the inlet to the chamber to the hot gases.

10. The spark plug as claimed in claim 9, wherein the expansion piece includes a corrugated sleeve, one end of which is fixed and an other end of which carries a shutter that blocks the inlet to the chamber when the sleeve has expanded to the second position.

11. The spark plug as claimed in claim 9, wherein the expansion piece includes a double-walled sleeve containing a metal that melts at a relatively low temperature, expansion of which causes the sleeve to swell so as to block the inlet to the chamber in the second position.

12. The spark plug as claimed in claim 9, wherein the first plasma-generating electrode is a central electrode housed in a central bore of the insulator.

13. The spark plug as claimed in claim 9, wherein the second plasma-generating electrode is an outer shell surrounding the insulator.

14. The spark plug as claimed in claim 9, wherein the chamber has a tubular first sector connected to a circular second sector that is open to outside of the spark plug.

15. The spark plug as claimed in claim 9, wherein walls of the chamber are metalized.

16. An internal combustion engine radio-frequency spark plug, comprising:

a first plasma-generating electrode;

a second plasma-generating electrode, the second plasma-generating electrode including an annular opening that extends from an exterior face into an interior of the second plasma-generating electrode to form a heat-exchange chamber opening to an outside of the spark plug;

an insulator that separates the first plasma-generating electrode and the second plasma-generating electrode; and an expansion piece positioned in the chamber and configured to open or close an inlet to the chamber to hot gases.

17. The spark plug as claimed in claim 16, wherein the expansion piece includes a corrugated sleeve, one end of which is fixed and an other end of which carries a shutter that closes off the inlet to the chamber when the sleeve has expanded.

18. The spark plug as claimed in claim 16, wherein the expansion piece includes a double-walled sleeve containing a metal that melts at a relatively low temperature, expansion of which causes the sleeve to swell so as to close off the inlet to the chamber.

* * * * *